United States Patent [19]

Erb et al.

[11] 4,161,281

[45] Jul. 17, 1979

[54] PNEUMATIC NEBULIZER AND METHOD

[76] Inventors: Elisha W. Erb, 444 Main St., Leominster, Mass. 01420; Darrel R. Resch, 18 Campbell Ave., Leominster, Mass. 01453

[21] Appl. No.: 821,374

[22] Filed: Aug. 4, 1977

Related U.S. Application Data

[63] Continuation-in-part of Ser. No. 718,647, Aug. 30, 1976, abandoned.

[51] Int. Cl.[2] ..... B05B 17/04

[52] U.S. Cl. ..... 239/8; 239/434; 239/496

[58] Field of Search ..... 239/5, 8, 338, 405, 239/418, 419.5, 424, 424.5, 425.5, 426, 429–431, 434, 496, 497

[56] References Cited

U.S. PATENT DOCUMENTS

| | | | |
|---|---|---|---|
| 619,834 | 2/1899 | Schulke | 239/426 X |
| 1,436,351 | 11/1922 | Metcalf | 239/407 |
| 1,437,201 | 11/1922 | Schumann | 239/431 |
| 2,213,522 | 9/1940 | Holmboe et al. | 239/434 |
| 2,354,151 | 7/1944 | Skoglund | 239/431 X |
| 2,599,422 | 6/1952 | Yettaw | 239/431 X |
| 2,906,089 | 9/1959 | Kadosch et al. | 239/434 X |
| 2,993,652 | 7/1961 | Curry | 239/388 |
| 3,774,842 | 11/1973 | Howell | 239/25 |

FOREIGN PATENT DOCUMENTS

| | | | |
|---|---|---|---|
| 559913 | 8/1957 | Belgium | 239/496 |

*Primary Examiner*—Robert W. Saifer
*Attorney, Agent, or Firm*—Thomas L. Tully

[57] ABSTRACT

Pneumatic nebulizer and method for uniformly supplying variable small amounts of flowable liquid into a gas flow to form a stable dispersion having the appearance of a natural fog and consisting essentially of microscopic particles of said liquid dispersed in said gas. The nebulizer comprises a means for controlling the rate of flow of said liquid, a mixing element having one or more narrow liquid orifices through which the liquid is supplied in uniformly fine amounts, a filming surface onto which the liquid is drawn and stretched and a gas orifice which introduces the stretched liquid film into the gas flow. The mixing element, which may be a replaceable unitary element, comprises a filming surface having an affinity for the liquid being dispersed in the gas flow, at least one liquid passage adapted to receive a regulated supply of said liquid and having a very small exit orifice on said filming surface and adapted to transmit said liquid to said filming surface, and a gas orifice communicating with an edge of said filming surface and spaced from said very small liquid orifice and adapted to receive liquid from said filming surface in the form of the thinnest continuous filament or film of said liquid which can be drawn across said surface by the cohesive force between the liquid being dispersed at said gas orifice and the liquid on said surface.

49 Claims, 14 Drawing Figures

Figure 5:
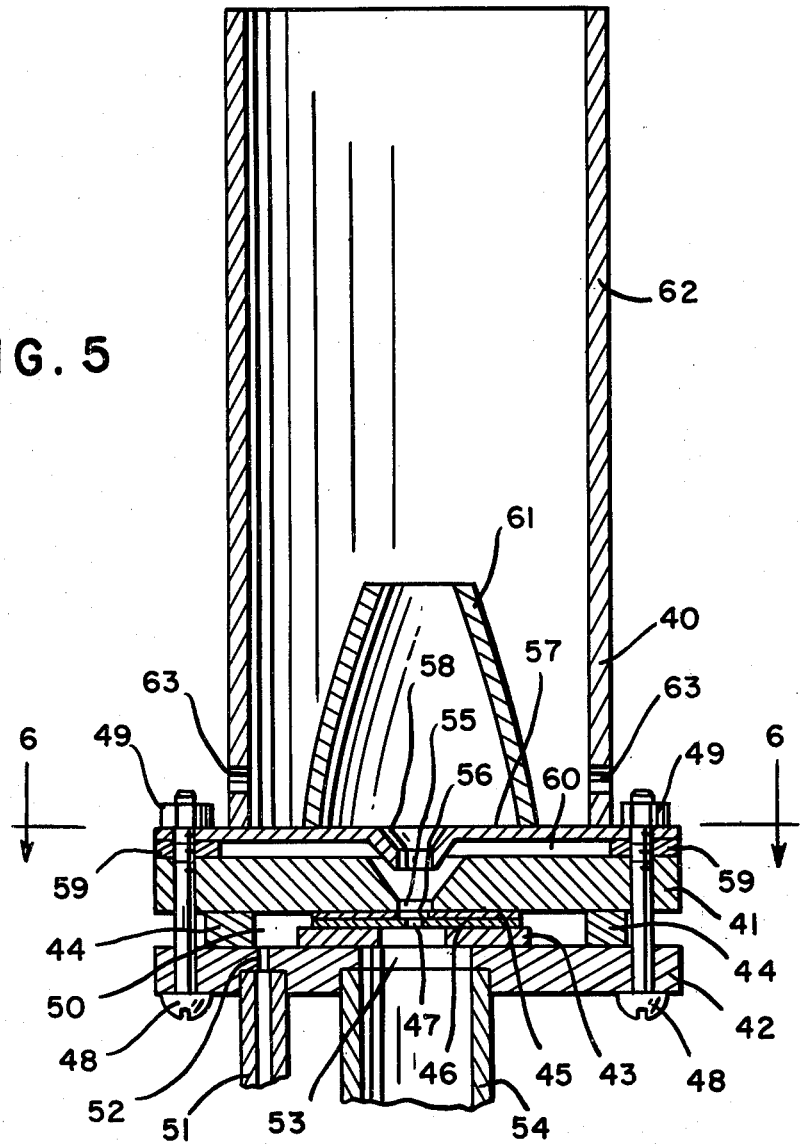

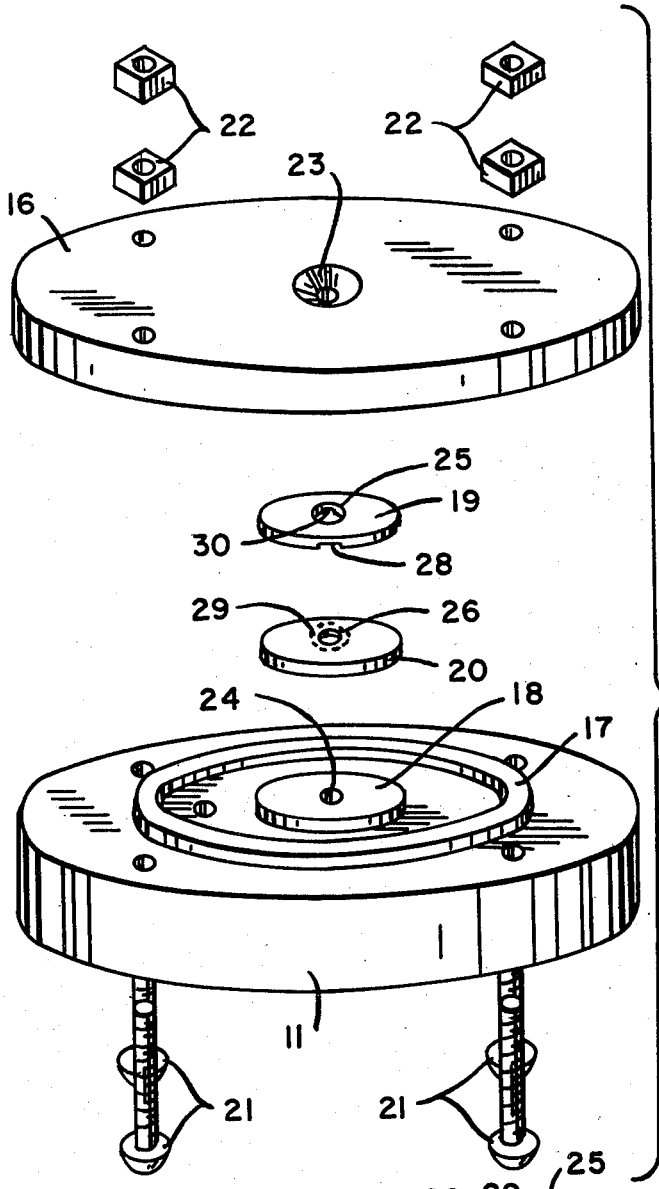
FIG. 1
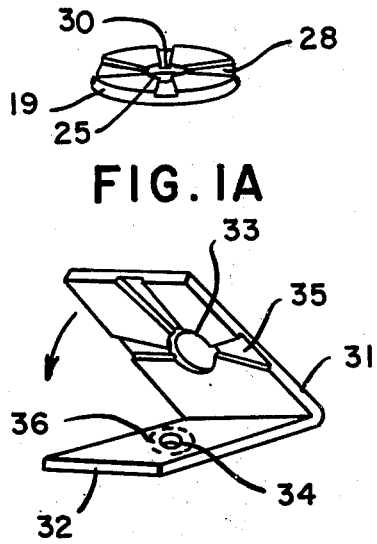
FIG. 1A
FIG. 4
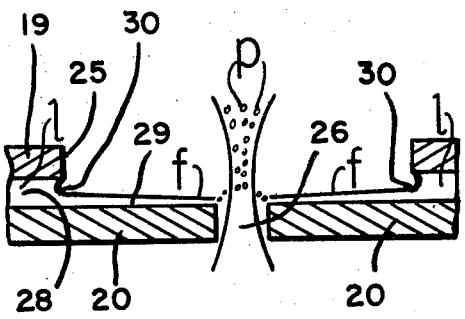
FIG. 3
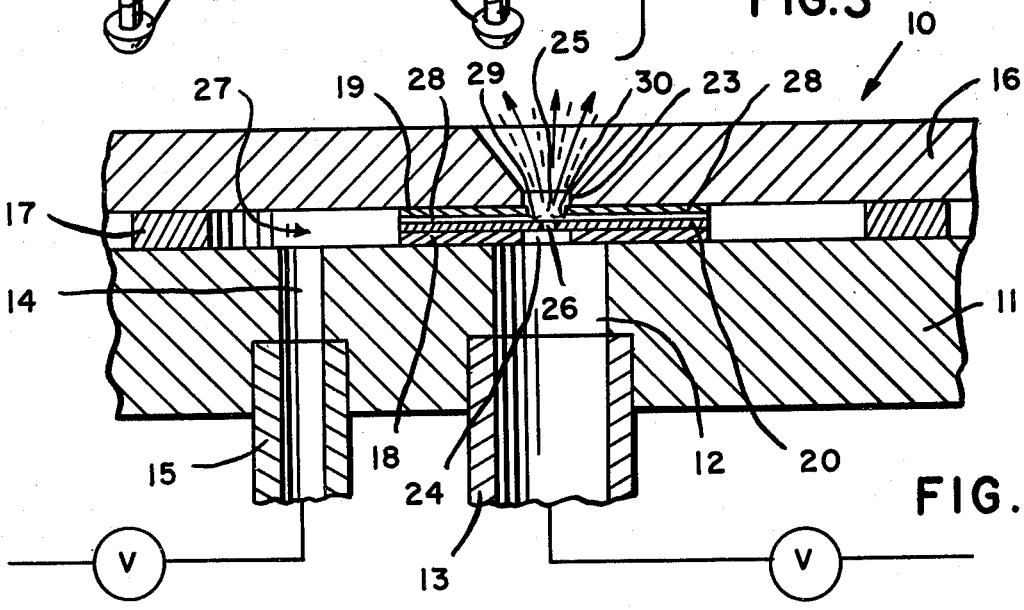
FIG. 2

PNEUMATIC NEBULIZER AND METHOD

This application is a continuation-in-part of copending application, Ser. No. 718,647, filed Aug. 30, 1976 now abandoned.

The present invention relates to improved pneumatic nebulizers, including fuel burners, carburetors, etc., and to methods for producing an ultrafine stable dispersion of a flowable liquid in a gas.

A pneumatic nebulizer is a device which uses a flow of gas to disperse a fluid, such as a liquid, as fine particles. The ideal liquid dispersing pneumatic nebulizer is one which (1) disperses the liquid as the smallest possible particles; (2) requires the least amount of gas; (3) operates with the gas at the lowest possible pressure; and (4) is adjustable to permit the generation of liquid dispersions of different concentrations.

It is well known that a high speed flow of gas impinging on a liquid filament or film will rupture the liquid filament or film and disperse it as small particles and that the thinner the liquid filament or film, or the greater the velocity of the gas with reference to the liquid filament or film, the smaller the dispersed liquid particles. Accordingly, many pneumatic nebulizers consist of elements which produce a thin liquid filament or film and then expose the thin liquid filament or film to a gas flowing at a high velocity.

Common devices for pneumatically nebulizing a liquid as described above are those devices which squirt a thin filament or film of the liquid into a high speed flow of gas. Examples of such devises include devices which:

(a) supply liquid to a small orificed nozzle whose outlet is within or adjacent a high speed flow of gas—such as the standard automobile carburetor;

(b) supply liquid under pressure between two elements which are held a small fixed distance apart, the space between the elements opening into a high speed flow of gas—see Howell U.S. Pat. No. 3,774,842;

(c) supply liquid under pressure between two elements which are held an adjustable distance apart, the space between the elements opening into a high speed flow of gas—see Parker U.S. Pat. No. 1,307,875;

(d) are identical to the foregoing except the liquid is not supplied under pressure because the place where the liquid enters the high speed flow of gas is at a partial vacuum, and the partial vacuum draws in the liquid—see Holmboe U.S. Pat. No. 2,213,522.

Devices such as those described above have the disadvantage that the thickness of the liquid filament or film squirted or drawn into the high speed flow of gas is approximately the fixed width of the nozzle orifice or the fixed distance between the elements. The liquid is not drawn out into a thinner filament or film after exiting the nozzle or exiting from between the elements and before exposure to the high speed flow of gas. As a consequence, the liquid filament or film is not the thinnest possible liquid filament or film when struck by the flowing gas. Devices such as (a) and (b), in their basic form, function properly only within a narrow range of liquid flow rate about the designed operating liquid flow rate. Devices such as (c) described above and the comparable type (d) devices have the disadvantage that they must be manufactured so as to be adjustable, must be adjusted from time to time, may go out of adjustment due to variations in the pressures involved, contaminates in the liquid coating the elements, flexibility of the elements, expansion and contraction due to increase or decrease in temperature, etc.

Other common devices which pneumatically nebulize a liquid by filming the liquid and exposing the liquid film to a high speed gas flow and which avoid the difficulties of the devices described above are those devices which spread the liquid on a surface as a thin filament or film and then expose the thin filament or film of liquid to a high speed blast of gas. Several devices use this method. Examples include:

(a) Supplying the liquid to the top of a downward sloping surface, a gas orifice being at a lower point in the surface. Gravity and adhesive forces between the surface and the liquid cause the liquid to flow downward across the surface, to spread upon the surface as a thin film, and to eventually come into contact with gas exiting the gas orifice. Babington U.S. Pat. No. 3,421,692 is a representative of such devices.

(b) Supplying the liquid at the base of a rising surface, a gas orifice being at a higher point on the surface. The liquid is drawn upward on the surface against the force of gravity by (1) the attractive forces between the molecules in the liquid and the molecules of the surface (this attractive force will hereinafter be described as "adhesive force", or in certain situations, "capillary force") and (2) the attractive forces between the molecules of liquid, one to the other, being removed at the gas orifice and the adjoining molecules of liquid (this liquid molecule to liquid molecule attractive force will hereinafter be described as "cohesive force"—the literature in certain situations sometimes calls it "surface tension"). The liquid film on the surface becomes thinner as it rises above the liquid supply. By careful adjustment, the gas orifice can be located above the liquid supply such that the gas orifice is exposed to a thin film of the liquid. Johnson U.S. Pat. No. 3,584,792 is representative of such devices as well as of (c) below.

(c) Supplying the liquid at the base of a narrow conduit, a gas orifice adjoining the top thereof. Capillary force draws the liquid up the narrow conduit against the force of gravity. Cohesive force between the liquid being removed at the gas orifice and the adjoining liquid draws liquid from the narrow conduit and (if there is an intervening surface between the top of the narrow conduit and the gas orifice—across the intervening surface) to the gas orifice.

(d) Supplying the liquid at a controlled rate to a horizontal confined surface, (such as the base of a cup) with a vertical gas orifice through the horizontal surface. The liquid gradually covers the horizontal surface and eventually comes into contact with gas exiting the gas orifice. Urbanowicz U.S. Pat. No. 3,473,530 is representative of such devices.

All of the foregoing filming devices are limited because none of them, in their basic form, can be operated in an inverted position and all of them are affected by strong vibrations. They also suffer from the difficulty that if they are supplied with liquid at a sufficiently low rate so that the liquid film becomes exceedingly thin—that is, stretched as hereinafter described—, adjacent the gas orifice or are adjusted to cause the liquid film to become exceedingly thin adjacent the gas orifice, the slightest irregularity or vibration will cause the exceedingly thin liquid film to break some distance from the gas orifice. That portion of the exceedingly thin liquid film between the break and the gas orifice will be drawn to the gas orifice. In devices utilizing a downward sloping surface, that portion of the exceedingly thin film above the break will draw together to form rivulets which flow down the surface. In devices utilizing an upward sloping surface or a narrow capillary conduit, that portion of the exceedingly, thin film behind the break will fall back and the nebulizer will cease operating until steps are taken to re-establish the film. In devices utilizing a horizontal surface, that portion of the exceedingly thin film behind the break will fall back or remain in place until sufficient liquid accumulates behind the break to cause the liquid film to become thicker and to spread to the gas orifice. As a consequence, none of the foregoing devices can be operated on a continuous un-interrupted basis with exceedingly thin liquid films.

The invention disclosed herein concerns a method and devices which produce continuous uninterrupted exceedingly thin liquid filaments or films and exposes them to gas flowing at high velocity. Because the liquid filaments or films are exceedingly thin when first exposed to a high speed gas flow, embodiments of the invention will generate exceedingly small liquid particles at both low gas flow and low gas pressure combined.

The principal object of the present invention is to provide an improved pneumatic nebulizer which is capable of directly and uniformly generating an ultrafine stable fog of liquid particles, preferably having a mean geometric diameter of about 3 microns or less, in a propellant gas.

Another object of this invention is to provide an improved apparatus for generating an ultrafine fog of liquid particles in a propellant gas whereby the total weight of the liquid particles for a given weight of the propellant gas can be varied and controlled within close limits independently of the pressure of the propellant gas.

Another object of this invention is to provide an improved nebulizer in which all of the liquid is supplied to the liquid orifice means as a thin stretched film and is nebulized and dispersed as an ultrafine stable fog, i.e., there is no build-up of liquid at the gas orifice, no liquid run-off and no drippage of liquid from the orifice means or from other parts of the nebulizer.

Another object of the present invention is to provide a pneumatic nebulizer having a confined liquid supply whereby the nebulizer may be moved, tilted, inverted or vibrated during use without interrupting or changing the uniformity of the supply of liquid as a thin stretched film to the propellant gas or interfering with the uniform fog emission.

It is yet another object according to one embodiment of the present invention to provide a pneumatic nebulizer which has a unitary mixing element comprising at least one fixed liquid orifice and passage and at least one fixed gas orifice and passage, preferably a sharp-edged gas orifice, the relative sizes of said liquid passage and said gas passage being predetermined, said liquid orifice and said gas orifice being spaced by a filming surface having an affinity for said liquid, and said mixing elements preferably being interchangeable for different liquids and/or replaceable when worn or contaminated.

Figure 6:
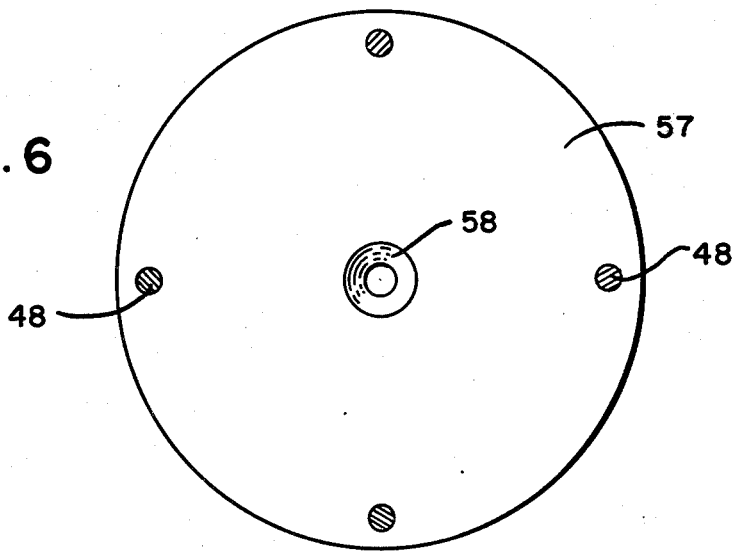

These and other objects and advantages of the present invention will be apparent to those skilled in the art in the light of the present disclosure, including the drawing in which:

FIG. 1 is a perspective view of a nebulizer assembly according to one embodiment of the present invention, the elements thereof being shown spaced and disc 19 also being shown in inverted position, for purposes of illustration, in FIG. 1A, FIGS. 2 and 3 are diagrammatic partial cross-sections of the nebulizer device of FIG. 1, illustrating the elements in magnified assembled position and in operation, FIG. 4 is a perspective view of a unitary mixing element suitable for use in the nebulizer assembly of FIG. 1 or of FIG. 5, FIG. 5 is a diagrammatic cross-section of a nebulizer-burner structure according to one embodiment of the invention, FIG. 6 is a plan view of the baffle plate of the nebulizer-burner structure of FIG. 5 taken along the line 6—6, FIGS. 7 to 13 are perspective and side views of various mixing elements suitable for use according to different embodiments of the present invention.

The present invention is based upon the discovery that a confined liquid can be dispersed in a propellant gas to form a continuous and uniform, stable, ultrafine dispersion having the appearance of a natural fog containing the liquid in the form of particles having a geometric mean diameter of less than about 3 microns. This is accomplished by subjecting the liquid to three different, yet cooperative, forces which cause the liquid to be forced from its confinement container, to be drawn into the thinnest possible continuous film and to be dispersed in the propellant gas as an ultrafine dispersion, an equilibrium being established between the rate of supply of said liquid and the rate of dispersion of said liquid, which equilibrium is not affected by gravity, vibration or other external forces.

The nebulizers of the present invention comprise a mixing element having at least one thin liquid passage adapted to convey liquid forced therethrough as a thin liquid stream, and a liquid orifice or exit from said liquid passage opening onto a filming surface. The mixing element also comprises a propellent gas orifice which is an edge of said filming surface, sufficiently spaced from said liquid orifice that the thin liquid stream which exits said liquid orifice and adheres to said filming surface is caused to flow over said filming surface, forming a continuous film of the liquid which is even thinner than the thin liquid stream which exits the liquid orifice and which reaches its thinnest possible, yet continuous, state at the point which it contacts the edge of the filming surface which comprises the gas orifice. At this point the thin liquid film is drawn into the flow of propellant gas flowing through the gas passage which comprises the gas orifice.

The three separate forces acting upon the liquid in the nebulizer devices of the present invention are (1) sufficient pressure on the liquid up stream (behind) the liquid orifice to force the liquid through the liquid orifice; (2) adhesive force between the liquid and filming surface, which adhesive force causes the thin liquid stream exiting the liquid orifice to adhere to and spread over the filming surface; and (3) cohesive force which (a) causes the thin liquid film to retain its continuity as the liquid is drawn over the filming surface, and (b) also causes the liquid being removed from the edge of the filming surface at the gas orifice into the flow of propellant gas to draw to the edge of the filming surface liquid on the filming surface. An equilibrium is established between the rate at which the liquid is supplied to and removed from the filming surface to maintain liquid on the filming surface in the form of a continuous film extending from the liquid orifice to the gas orifice. The thinnest possible continuous film on the filming surface produces the finest possible uninterrupted fog and such a state of preferred equilibrium can be attained by either reducing the rate of the liquid supply or increasing the rate of the gas flow until the liquid film breaks as evidenced by a cessation or pulsation of fog emission. Thereafter the liquid supply rate is increased slightly or the gas supply rate is reduced slightly until continuous fog emission resumes.

If the exceedingly thin liquid film is drawn from the filming surface into the gas flow substantially simultaneously with the dispersion of said gas flow into a large receptacle or open space, the expansion of the gas disperses the thin liquid film as fine particles and prevents the fine particles of liquid from coalescing into large droplets.

The present invention contains three important elements. The first important element is the filming surface which exists between and communicates with the liquid orifice and the gas orifice spaced therefrom. The filming surface has an affinity for the particular liquid with which it is used so that the adhesive forces between the liquid and the surface cause the liquid to adhere to the filming surface and to spread upon or wet the filming surface. As long as the amount of liquid on the filming surface is maintained sufficiently small, the adhesive force prevents the liquid from dripping from or flowing off the filming surface.

The second important element is the very small liquid orifice. This is because if the liquid orifice is very small, capillary force will hold the liquid in the liquid passage until the combined pulling and pushing effects of the various other forces acting on the liquid exceeds the capillary force. The smaller the liquid orifice, the greater the capillary force, and consequently, the greater must be the combined pulling and pushing effects of the various other forces acting on the liquid to draw-push liquid out of the liquid orifice. If the liquid orifice is very small, the force required to cause liquid to flow out of the liquid orifice can be greater than the net effect of the combined push and pull on the liquid in the liquid orifice resulting from (a) the cohesive force which draws the liquid across the filming surface; (b) the adhesive force which draws the liquid onto the filming surface; (c) the gravitational force on the liquid in the liquid orifice; and (d) the differences between the liquid pressure behind the liquid orifice and the ambient pressure at the mouth of the liquid orifice. When the strength of the capillary force retaining the liquid in the small liquid orifice is greater than the net effect of the combined push-pull effect on the liquid in the liquid orifice of the adhesive force, the cohesive force, gravity and the difference in pressure—the liquid will not flow out of the liquid orifice. As a consequence, it is possible by use of a sufficiently small liquid orifice to supply liquid to the filming surface at an adjustable stable very low rate of flow regardless of the drawing power of the cohesive force, and/or regardless of the drawing power of adhesive force, and/or regardless of the ambient pressure at the mouth of the liquid orifice by simply controlling the rate at which liquid is supplied to the liquid orifice at a sufficient pressure to force the liquid therethrough. This would not be possible—i.e. supplying liquid to the filming surface at an adjustable stable low rate of flow by simply regulating the rate at which liquid is supplied to the liquid orifice—if the liquid orifice was not critically small as defined herein. This is because if the liquid orifice was not critically small and liquid was supplied thereto at a controlled low rate, the cohesive force between the liquid being removed from the filming surface at the gas orifice and the liquid film on the filming surface, which cohesive force draws liquid from the liquid orifice across the filming surface to the gas orifice, in conjunction with the adhesive force, and for downward sloping liquid orifices—in conjunction with gravity, would draw liquid out from within the interior of the liquid orifice, i.e. tunneling into the liquid orifice. As liquid is supplied to the liquid orifice at a controlled low rate, liquid would be drawn from the mouth of the liquid orifice faster than liquid was supplied to the liquid orifice until the interior of the liquid orifice had been emptied for some distance and the liquid flow out of the liquid orifice interrupted. Thereafter, liquid flowing into the liquid orifice at the controlled low rate would refill the liquid orifice and ultimately cause liquid to flow out of the liquid orifice onto the filming surface. When the liquid on the filming surface contacted the gas flowing from the gas orifice, the liquid on the filming surface would be drawn into the gas flow, re-establishing the drawing force between the liquid being removed from the filming surface and the liquid on the filming surface, starting the cycle again. The end result is the pneumatic nebulizer operated in pulses.

The fact that for critically small liquid orifices, liquid may be supplied to the filming surface at an adjustable low rate of flow which is steady and continuous regardless of the orientation in space of the liquid orifice, or the strength of the adhesive and cohesive forces, makes it possible to set the rate of flow to less than the rate at which the cohesive force between the liquid being dispersed at the gas orifice and the liquid on the filming surface is capable of drawing liquid from the liquid orifice. The fact that liquid may be supplied to the filming surface at a steady rate which is less than the rate at which the cohesive force between the liquid being dispersed at the gas orifice and the liquid on the filming surface is capable of drawing liquid from the liquid orifice, makes it possible to stretch the liquid on the filming surface to a stable stretched exceedingly thin liquid film.

It is critical to the invention described herein that the liquid orifice be sufficiently small so that the net push-pull effect of the various forces acting on the liquid in the liquid orifice, other than capillary force, can be adjusted to be less than the capillary force, i.e. can be adjusted to stop the liquid flow at the mouth of the liquid orifice. The critical dimensions of the liquid orifice for any particular application depends on the relationship between the size of the liquid orifice and the strength of the capillary force, the strength of the pulling effect on the liquid in the liquid orifice of the cohesive force which draws the liquid across the filming surface, the strength of the pulling effect on the liquid in the liquid orifice of the adhesive force between the liquid and the filming surface, the positive or negative strength along the axis of the liquid orifice of the gravitational force acting on the liquid in the liquid orifice and the positive or negative strength of the difference between the pressure in the liquid behind the liquid orifice and the ambient pressure at the mouth of the liquid orifice.

An additional consequence of the liquid orifice being sufficiently small so that the net push-pull effect of the various forces acting on the liquid in the liquid orifice, other than capillary force, can be adjusted to be less than the capillary force is that pneumatic nebulizers based on the within invention may be operated in any direction, such as straight down, and will also operate under vibration. Because the liquid orifices of pneumatic nebulizers based on the within invention are of critical size as defined herein or smaller, liquid will not flow from the liquid orifice at a rate greater than the controlled supply rate. This fact, in conjunction with the fact that the adhesive force between the liquid and the filming surface causes the liquid on filming surface to adhere to the filming surface, prevents liquid from dripping from the pneumatic nebulizer regardless of its orientation in space or vibration, so long as the liquid supply rate does not exceed the rate at which liquid is removed from the filming surface by the gas flow.

The third important element is means for regulating the rate of flow of liquid through the liquid orifice to a rate of flow which is less than the rate at which the cohesive force between the liquid being dispersed at the gas orifice and the liquid on the filming surface is capable of drawing from the liquid orifice. The thickness of the liquid film at the edge of the gas orifice can be maintained exceedingly thin by adjusting the rate at which liquid passes through the liquid orifice to the lowest rate at which continuous atomization can be obtained.

The essential components of the within method for pneumatically atomizing liquids—the use of a very small liquid orifice of the critical smallness described herein or smaller, a filming surface, and a means for supplying a controlled flow of liquid through the liquid orifice—is not taught in the prior art. For example, in Johnson U.S. Pat. No. 3,584,792, the liquid orifices are comparatively large as is clear from the fact that devices based on Johnson must have the gas orifice located above the surface of the liquid supply, the liquid may not pass over a surface having a higher elevation than the gas orifice and the axis of the gas orifice may not be directed below the horizontal. Johnson is based on the principal that gravitational force, in conjunction in certain embodiments with difference between the pressure on the liquid supply and the pressure at the mouth of the liquid orifice, restrains the liquid from flowing upwards. The stressed liquid film described in Johnson is created by carefully slightly over balancing the upward lifting effects on the liquid of the adhesive force, cohesive force, capillary force, and pressure differential acting on the liquid on the filming surfaces described in Johnson against the downward gravitational force acting on the liquid.

While the size of the exit orifices of the present nebulizers may be varied, depending upon the density or viscosity of the liquid being dispersed and the desired end results, such orifices generally have a diameter or spacing of 0.01 inch or less and preferably 0.003 inch or less. Such diameter or spacing refers to the smallest distance between opposite points of the exit orifice. In the case of larger orifices, the capillary attraction of the liquid within the orifice is insufficient to overcome the cohesive, adhesive and gravitational forces acting on the liquid and therefore the liquid will not remain in the orifice, as required by the present invention.

The thickness of the liquid filament or film can be maintained at the least possible thickness, without destroying the continuous nature of the filament or film by controlling the relative rates of supply and removal of the liquid from the filming surface. Such a high degree of control of the liquid film thickness is not possible if the liquid orifice is not very small or if the length of the filming surface between the liquid orifice and the gas orifice is too small or too great. If the length of the filming surface is too small the liquid will not have enough surface to form a stretched filament or film of the desired thinness prior to contacting the gas orifice and therefore the finest possible fog will not be generated. If the length of the filming surface, between the liquid orifice and the gas orifice, is too great it is difficult to maintain the thin liquid film as a continuous film on the filming surface without breakage or disruption. However, provided that there is a filming surface of some length between the small liquid orifice and the gas orifice it is generally possible to adjust the rate of liquid supply and/or the rate of gas supply to permit filming of the liquid and generation of an ultrafine fog.

Another related discovery is that the amount of a liquid dispersed in a gas, i.e., the amount of fog created, can be varied and controlled within close limits substantially independently of the pressure or volume of the gas by varying the rate at which the liquid is fed to the filming surface for movement into the gas flow.

Still another related discovery is that a thin film of liquid will not drip from or form droplets on a filming surface of appropriate size which has an affinity or adhesion for said liquid, i.e., the adhesive forces are stronger than the force of gravity on such film, whereby such film and the nebulizer containing the same may be used in any position in space without drippage of the liquid or interference with the uniformity of nebulization.

FIGS. 1 and 2 of the drawing illustrate a unitary nebulizer device adapted to be connected to sources of a liquid and a gas to cause atomization of the liquid in the form of an ultrafine stable fog. The device 10 comprises a circular base plate 11 having a central opening 12 adapted to be connected to a pneumatic conduit 13 and having an offset opening 14 connected to a liquid-supply tube 15. The base plate 11 is sealingly connected to a circular top plate 16 by means of a compressible outer ring gasket 17 and a compressible inner washer gasket 18 which sealingly confines between itself and the undersurface of top plate 16 circular nebulizer discs 19 and 20. Four bolts 21 and nuts 22 unite plates 11 and 16 with an adjustable pressure, due to the compressibility of gaskets 17 and 18. The plates 11 and 16 and gasket 18 are provided with central openings 12, 23 and 24 respectively, and the nebulizer discs are also provided with central openings 25 and 26, the latter being smaller in diameter than openings 23 and 24, and forming a restricted sharp-edged gas orifice through which the gas from the pneumatic conduit 13 must pass. Hole 25 in the top disc 19 is substantially larger in diameter than hole 26 in disc 20 so that the liquid which passes through recess areas 28, which comprise the narrow liquid passages most clearly shown in the inverted view between the discs, is able to escape from the small liquid orifices 30 onto outer filming surface 29 of lower disc 20 within hole 25 of top disc 19 and lay down as a thin layer on surface 29 in the center of disc 20, shown by broken lines, as it is drawn to the smaller gas orifice 26. All five central openings are coaxial in the assembled device to form a gas-flow passage and the flow of the gas through the most restricted orifice 26, which is the gas orifice, causes the gas to form a vena contracta at a distance beyond orifice 26 equal to approximately one-half the diameter thereof, and then to expand in a pattern as illustrated by FIGS. 2 and 3.

As illustrated, the sealed confinement of gaskets 17 and 18 between plates 11 and 16 provides a circular chamber 27 to which liquid supplied to the device through supply tube 15 has access.

The circular discs 19 and 20, with their aligned central openings 25 and 26, have conforming surfaces which lie in sealing engagement with each other except only the shallow conduits therebetween comprising recessed areas 28. Upper disc 19 is provided on its undersurface with narrow shallow, recessed areas 28, formed by etching or grinding away a thickness of about 0.01 inch or less of the metal therefrom, to provide very small liquid orifices 28 between the assembled discs 19 and 20 which extend radially from the periphery of discs 19 and 20 and communicate with the central opening 25 of top disc 19, forming at such point liquid orifices 30 which exit onto the central filming surface area 29 of lower disc 20, shown by broken lines in FIG. 1 and also in FIG. 2.

In operation, a gas is supplied under pressure through pneumatic conduit 13 so that it flows forcefully through openings 12, 24, 26, 25 and 23 and exits into the atmosphere, forming a vena contracta and an unobstructed flow pattern as shown by FIG. 2. A liquid is supplied under pressure through supply tube 15 to circular chamber 27 where it is sealingly confined except for escape through the recessed very narrow liquid passages comprising recesses 28 between discs 19 and 20, which passages have their exit orifices 30 at central disc opening 25. The pressure of the liquid provides a continuous supply of the liquid l at the orifices 30, as shown by FIG. 3. As illustrated, the liquid l is attracted to receptive filming surface 29 in the area between the central openings 25 and 26 of the discs as a very thin film f of the liquid having a thickness of less than 0.010 inch.

The thin liquid film f covers surface 29 and extends to central gas orifice 26 where it is exposed to the blast of the gas flow from pneumatic conduit 13. The then liquid film f is immediately reduced to an ultrafine dispersion of liquid particles p having a geometric mean diameter of about 3 microns or less which are carried through opening 25 by the propellant gas in the form of a stable fog as illustrated by FIG. 3. In the embodiment illustrated by FIGS. 2 and 3, the thin liquid film enters the gas flow as the gas flow approaches its vena contracta and the liquid is reduced to the ultrafine dispersion. Thereafter the gas expands in a pattern, as illustrated, and flows unobstructed into the atmosphere due to the chamfered structure of orifice 23 of the top plate 16. If orifice 23 was not chamfered the gas flow might strike the inner surface of the orifice depending upon the gas pressure and the thickness of the plate 16. This would cause the dispersed liquid particles to wet said surface and flow back into orifice 25 and would also cause a vacuum to be created in orifice 23 above disc 19.

The discs 19 and 20 of FIGS. 1 and 2 are preferably formed of stainless steel having a thickness of at least about 0.01 inch to prevent flexing of the discs within the recessed areas 28. Because of the supporting contact between the discs the very narrow and shallow liquid passages 28 retain their small size regardless of variations in the liquid pressure.

It appears that the improved performance of the present nebulizer devices is due to a number of important cooperative features. First the constant supply of the liquid through the very narrow shallow liquid passages 28 between the contacting nebulizer discs 19 and 20 causes the liquid to exit from orifices 30 in the area of the central disc opening 25 at a constant rate from which area it is drawn across surface 29 as a very thin filament or film f having a thickness of 0.001 inch or less, in which condition the liquid is reduced to a multiplicity of extremely fine liquid particles at gas orifice 26.

A second cooperative feature of the present devices is the provision of a continuous gas flow at an angle to, preferably substantially perpendicular to, the direction of flow of the liquid film f on surface 29, which gas flow passes through the central disc opening 26 and draws or pulls the liquid filament or film f from the surface 29 as an exceedingly thin liquid filament or film at the edges of central gas orifice 26 and disperses the liquid in the form of minute particles p. Because the liquid film f adjacent gas orifice 26 is exceedingly thin, it shatters when drawn into and struck by the gas flow, forming a multiplicity of microscopic liquid particles p having a geometric mean diameter of less than about 3 microns which are carried along in the gas flow.

A third cooperative feature of the present devices, according to a preferred embodiment of the present invention, is the abrupt restriction in the gas flow provided by gas orifice 26 in disc 20 which forms a sharp-edged gas orifice. The gas flow pattern contracts as it flows from the relatively wide area under disc 20 through the relatively narrow area of hole 26 in disc 20. The gas flow pattern continues to contract for some distance beyond disc 20. The point of greatest contraction is known as the vena contracta of the gas flow pattern and is shown in FIGS. 2 and 3 as the most narrow of the illustrated gas flow pattern. The gas flow reaches its greatest velocity at this point of greatest contraction and thereafter the gas flow pattern diverges. Because the gas flow carries away everything contacting it as it leaves gas orifice 26 in disc 20, a slight vacuum is created in the area of orifice 26 which helps the cohesive force between the departing liquid and the liquid on surface 29 draw or pull the thin liquid film f towards orifice 26 and into the gas flow. The rate at which the liquid film is drawn over surface 29 and into the gas flow will depend in part upon the characteristics of the liquid and in part upon the pressure under which the gas is forced through gas orifice 26 and in part upon the rate at which the liquid is supplied to liquid chamber 27 and through liquid orifices 28. The finest possible fog is produced by maintaining the rate of removal and the rate of supply of liquid to filming surface 29 at that equilibrium which results in an exceedingly thin continuous filament or film of liquid on surface 29 adjacent gas orifice 26. This is accomplished by supplying liquid through conduit 15 at a slow and steady rate and under slight, but sufficient, pressure to force a slow steady flow of liquid out of orifices 30 at opening 25 onto filming surface 29 where the liquid can be drawn across surface 29 as a very thin filament or film by the cohesive forces between the liquid being removed from surface 29 at gas orifice 26 and the remaining liquid on surface 29 and by the suction created by the gas flow.

A fourth cooperative feature of the present devices, according to a preferred embodiment of the present invention, is the unobstructed passage of the liquid-particle-carrying gas flow into the atmosphere or into a larger chamber being supplied thereby. This is accomplished by excluding from the path of the gas flow any portion of the device which could be contacted by the diverging gas flow pattern. Thus if the device has a top plate or other element beyond the central discs, which would normally be contacted by the expanding gas flow the central orifice of such top plate or other element must be sufficiently large or the plate must be sufficiently thin or must be outwardly chamfered, as shown by FIG. 2, to prevent the gas flow from striking the surface of the plate or other element before it escapes into the atmosphere. If the expanding gas flow pattern strikes the surface of the plate or any other solid surface in the vicinity of the disc openings, the dispersed liquid particles will coalesce on that surface and increase in size until the surface becomes wet with the liquid and droplets form thereon. Many of said droplets will be blown off the surface on which they form by the flowing gas, thereby contaminating with relatively large droplets the fine dispersed liquid particles contained in the flowing gas. In addition, if the expanding gas flow pattern strikes the central orifice of the top plate, some of said droplets will run down the sides of the central orifice and onto disc 19, eventually entering central opening 25. This is a second source of large liquid particles in the gas flow because the liquid which enters in the area of the central disc opening 25 augments, and thereby makes thick, the thin liquid filaments or films flowing within opening 25, resulting in sizable droplets.

In some instances where the atmosphere being treated is itself contained within a confined receptacle, such as in the case of automobile carburetors, face masks, etc., the advantages discussed above resulting from the unobstructed passage of the liquid-containing gas flow or fog must be compromised to some extent, but in all cases the liquid is in the form of a very thin filament or film having a thickness of less than 0.001 inch when the gas flow contacts the liquid. The gas then flows into a larger area so that the gas may expand for at least some distance to permit at least a substantial percentage of the fine liquid particles to become widely dispersed.

As discussed supra the passage of the gas flow from a large space to a confined, narrow space as it passes from the space under disc 20 to the central opening 26 of the nebulizer disc 20 causes the formation of a vena contracta and then a substantial dispersement of the gas flow, with attendant reduction in gas pressure. The thin liquid filament or film is drawn into the gas flow in the vicinity of the vena contracta. This causes the already-thin filament or film of liquid to be torn apart by the fast moving gas in the vena contracta with resultant formation of exceptionally fine liquid particles to the apparent exclusion of liquid particles greater than about 20 microns in diameter and probably even to the exclusion of liquid particles greater than about 10 microns in diameter. The liquid particles are immediately dispersed by the expansion of the gas flow beyond the vena contracta. The emitted liquid dispersion has the appearance of a fine, stable fog.

It is an important requirement of the present invention that the gas flow be continuous and of sufficient velocity that the liquid film f be blown from the edge of surface 29, causing liquid to be drawn across surface 29 from orifices 30. Preferably the gas and liquid supply are pressurized but this is not necessary in cases where there is a vacuum in the receptacle or atmosphere being treated such as in the case of an automobile manifold. The manifold vacuum creates a suction in the area of the gas orifice and the liquid orifice, causing the gas, i.e., air, to be sucked through its orifice and causing the liquid, i.e., gasoline, to be sucked through its orifice and dispersed into the air flow for vaporization and perfect combustion.

FIG. 4 of the drawing illustrates a unitary mixing element comprising a top plate 31 and a bottom plate 32, which may be substituted for lower disc 20 and upper disc 19 of the device of FIG. 1 to provide excellent results. In use, plates 31 and 32 are folded over each other into intimate surface contact so that holes 33 and 34 are in fixed alignment, the exposed surface adjacent hole 34 comprising filming surface 36 shown by broken lines.

It should be pointed out that the lower disc 20 or plate 32 may be omitted, gasket 18 relocated above disc 19 or plate 31, and disc 19 or plate 31 may be used alone in association with the top surface of bottom plate 11 of the nebulizer of FIGS. 1 and 2 provided that the central opening 12 of plate 11 has a smaller diameter than the central opening of said discs, such as opening 25 of disc 19 and opening 33 of plate 31 whereby the exposed surface of plate 11 adjacent central opening 12 forms the filming surface.

The plate 31 of the mixing element of FIG. 4 is provided with narrow, shallow recessed areas 35 comprising liquid passages which may be formed by grinding or etching the lower surface of the plate in the areas shown. The depth of the recessed areas 35 is just sufficient to admit the fluid between the folded-over plates for release onto filming surface area 36 of plate 32, shown by broken lines. The adjustability of the tightness of plates 11 and 16 and the discontinuous intimate surface contact between the major portions of the surface areas of plates 31 and 32 permits the element to be compressed while the contacting surfaces of plates 31 and 32 support each other, as shown by FIG. 2 with respect to discs 19 and 20, so that the depth of the orifice in the recessed areas 35 will be stable, i.e., resistant to change with changes in the pressure applied to the liquid or to the gas.

The confinement of the liquid within a very small passage 28 or 35, forcing a slow steady flow of liquid through the passage, and the drawing of the liquid 1 in the form of an ultrathin film f from the liquid orifices across the surface 29 or 36 and into contact with the gas flow, is responsible for the ultrafine size of the resulting liquid particles p as the liquid is reduced to the thinnest possible filament or film and then broken into small particles. None of the liquid is broken into particles of larger size, as can occur when the liquid is fed in larger amounts or greater thicknesses, or if the gas flow is interrupted or insufficient. The confinement of the liquid and its affinity for the filming surface also permits the present nebulizers to be used in any position in space, including upside down, without any spillage or drippage of the liquid or any interruption of the spray activity. Thus such nebulizers are useful as hand-held devices for the spraying of paint, liquid fungicides and fertilizers and other materials where complete freedom of alternation of the spray direction is necessary.

It should be pointed out that regardless of the direction of the spray action, it is preferred that the direction of the flow of the gas be substantially perpendicular to the direction of the liquid as it exits the thin orifice. This causes the vena contracta of the gas to form in a direction perpendicular to the direction of the liquid flow in those embodiment of the present invention which utilize a restricted, sharp-edged gas orifice to form a vena contracta, and produces the finest fog possible with the present devices.

The nebulizer of FIGS. 1 and 2 of the drawing, per se or incorporating the other mixing elements disclosed herein in place of discs 19 and 20, can be adjusted to provide the most perfect ultrafine fog for a wide range of viscosity of the flowable liquid which is being dispensed.

FIG. 5 of the drawing illustrates a nebulizer 40 which is preferred for use as a burner element such as an oil burner or the like. Nebulizer 40 has a base unit which is similar in structure and function to the unit illustrated by FIGS. 1 and 2 of the drawing. Thus the base unit comprises a circular top plate 41, a circular base plate 42, a compressible inner washer gasket 43, a compressible outer ring gasket 44 and a mixing element comprising thin contacting nebulizer discs 45 and 46 which are confined between the inner gasket 43 and the undersurface of top plate 41 in such a manner as to prevent relative movement or slippage therebetween. Discs 45 and 46 are provided with central openings or holes which are aligned, the central hole in lower disc 46 being smaller in diameter than the central hole in upper disc 45 and providing a restricted, sharp-edged central gas orifice 47.

The plates of the base unit are held together by means of four bolts 48 and nuts 49 which are sufficiently tightened with an adjustable pressure to compress gaskets 43 and 44 and to urge the nebulizer discs 45 and 46 into intimate discontinuous surface contact. The lower surface of upper disc 45 may be provided with a series of spaced narrow shallow radial smooth recesses such as grooves or scratches which extend from the outer edge to the central opening and which are up to about 0.01 inch in depth and preferably are about 0.001 inch or less in depth. Alternatively discs 45 and 46 may be as illustrated by FIGS. 4 or 9 to 13 of the drawing. In all cases the recesses, such as grooves, scratches, depressions, etched areas, uncoated areas, etc., preferably are separated from each other by means of contacting areas of the discs or plates so that the contacting plate surfaces cannot be urged or flexed closer together by means of the gas pressure and so that a multiplicity of small liquid passages are provided between the discs or plates. Even if one liquid orifice becomes contaminated and blocked the other liquid orifices will continue to provide passageways for the liquid to the gas orifice.

The assembled lower unit provides a sealed circumferential liquid chamber 50 defined by the space between the inside surface of ring gasket 44, the outer edges of discs 45 and 46 and inner gasket 43 and the inside surfaces of plates 41 and 42. Plate 42 is provided with a hole 52 communicating with chamber 50 and with a liquid supply tube 51 adapted to supply the liquid to be nebulized, such as fuel oil, to chamber 50 under any desired pressure.

Base plate 42 is also provided with a central hole 53 and has attached thereto an air supply conduit 54 adapted to supply air at any desired pressure through hole 53, through disc passage 47, and through the central hole 55 in the upper plate 41, the latter being beveled as shown.

As with the nebulizer of FIGS. 1 and 2, the supply of air under pressure through conduit 54 and the regulated feeding of liquid through tube 51 causes the air to pass through restricted gas passage 47 while the liquid is drawn over receptive central filming surface 56 of lower disc 46 as a thin film from the outlets of the grooves between discs 45 and 46 and into the air flow. The liquid is dispersed as a multiplicity of fine particles as it enters the air flow in the area of the vena contracta of the gas within hole 55 of top plate 41.

According to the improved embodiment of FIGS. 5 and 6, the base unit is provided with an overlying baffle plate 57 such as a reflective metallic plate having a central hole 58 in alignment with central hole 55 of plate 41, baffle plate 57 being spaced from plate 41 by means of washers 59 to provide an air passage space 60 therebetween which communicates with the atmosphere. Plate 57 is provided with outer holes which communicate with the bolts 48 as shown by FIG. 6, and nuts 49 are applied to secure plate 57 in place.

A combustion cone or chimney 61 is provided over baffle plate 57 in alignment with hole 55 of plate 41, plate 57 serving as the floor of the combustion chamber. Finally, an optional exterior chimney element 62 may be applied, the latter being positioned to extend from the surface of the baffle plate 57 to a height greater than cone 61, as illustrated.

The liquid particle/air flow exits central gas passage 47 through the restricted, sharp-edged gas orifice comprising the central orifice of lower disc 46 and forms a vena contracta which extends above disc 46. The pressure in the vena contracta is substantially less than atmospheric pressure, thereby creating a partial vacuum in the area of hole 55. The air above plate 41 in the vicinity of hole 55 is aspirated into and becomes part of the liquid particle/air flow in the area of its vena contracta. The spacing of baffle plate 57 and top plate 41 permits external atmospheric air to be drawn through air passage 60 therebetween and enter the liquid particle/air flow as the latter exits central hole 55 in plate 41. Baffle plate 57 and air passage 60 permits external atmospheric air to satisfy the partial vacuum created by liquid particle/air flow and prevents liquid particles and gas located above baffle plate 57 being drawn into the space below baffle plate 57. Thus, when the nebulized liquid, such as fuel oil, is ignited within combustion cone 61, it burns evenly and continuously entirely above baffle plate 57. The fact that baffle plate 57 shields top plate 41 from the flame and the fact that cool atmospheric air is drawn through air passage 60 prevents top plate 41 and discs 45 and 46 from becoming hot.

When the nebulized liquid, such as fuel oil, is ignited, part of it burns above combustion cone 61 and part burns within combustion zone 61, causing combustion cone 61 to become very hot. The heat radiated inward from combustion cone 61 causes the fine particle of liquid fuel oil emerging from central gas passage 47 to vaporize almost instantaneously. The vaporized fuel mixes perfectly in the combustion cone with the air which had passed through central gas passage 47 and the air which had been drawn through air passage 60 into the liquid particle/air flow. The vaporized fuel burns with a uniform, translucent, nonluminous blue flame.

If a heat-resistant enclosure, such as metal chimney 62, is placed over combustion cone 61, as shown in FIG. 5, much of the heat of the flame is radiated to chimney 62, causing the latter to glow red hot. It is necessary to provide air inlets 63 for atmospheric air, such as a series of circumferential holes near the base of chimney 62, to permit additional air to be drawn into chimney 62 and maintain an even continuous blue flame in and bove combustion cone 61. The air inlets 63 may be adjustable in size to permit adjustment of the amount of air admitted within chimney 62.

Home heating oil (No. 2 fuel oil) was burned at the approximate rate of one pint per hour in a working model of the nebulizer shown in FIG. 5 and the exhaust gas analyzed by ORSAT. The exhaust gas contained 0.75% $O_2$, 0% CO and 14.5% $CO_2$ at a BACHARACH Smoke No. of 0, indicating nearly perfect combustion.

Since much of the air needed for complete combustion is drawn from the atmosphere through air passage 60 into the liquid particle/gas flow exiting central gas passage 47, only a relatively small amount of low pressure compressed air is required to supply air conduit 54 with sufficient air to operate the nebulizer shown in FIG. 5 as an efficient fuel burner.

The structure of the nebulizer or burner device of FIGS. 5 and 6 makes it possible to use the device as a relatively small automatic, i.e., electronically-controlled, oil burner capable of burning fuel oil in a very efficient manner at a rate as low as about one pint per hour. This is in contrast to currently-available automatic oil burners which burn a minimum of approximately six pints of fuel oil per hour.

An important advantage of the burner device of FIGS. 5 and 6 is that it is possible to control the ratio of the amount of liquid fuel to the amount of the air (including air drawn from the atmosphere) in the liquid fuel particle/air flow passing into the combustion chamber above baffle plate 57, thereby permitting such ratio to be adjusted for perfect combustion. Home heating oil (No. 2 fuel oil) requires 107 lbs. of air (approximately 1,400 cubic feet at atmospheric pressure) be supplied to the flame for perfect combustion of each gallon of fuel oil burned. Combustion will be incomplete if insufficient air is supplied to the flame. If excess air is supplied to the flame, the flame temperature will be reduced because heat is drawn from the flame to heat the excess air. The rate at which atmospheric air is drawn through air passage 60 into the liquid fuel particle/air flow is directly related to the rate at which the liquid fuel particle/air flow flows from central gas passage 47. Because of this, regulating the rate at which liquid fuel enters the burner device through conduit 51 and regulating the rate at which air enters the burner device through conduit 54 regulates both (1) the rate at which liquid fuel particle/air flow (including air drawn from the atmosphere) enters the combustion chamber above baffle plate 57 and (2) the ratio of the amount of liquid fuel to the amount of air (including air drawn from the atmosphere) in the liquid fuel particle/air flow entering the combustion chamber.

Another important advantage of the burner device of FIGS. 5 and 6 arises from the fact that only a relatively small air pump is required to furnish sufficient compressed air to the burner device to operate the nebulizer and to cause sufficient additional air to be drawn into and mixed with the liquid fuel particle/air flow for complete combustion. This is so because a low pressure zone or partial vacuum is created in the liquid fuel particle/air flow as it exits the nebulizer orifice, due to the creation of a vena contracta, and atmospheric air is sucked into the liquid fuel particle/air flow as it exits the nebulizer. A relatively large air pump is required to operate prior known pneumatic atomizer-type oil burners because all or almost all of the air required for combustion is forced through or around the atomizer or nozzle.

Another important advantage of the burner device of FIGS. 5 and 6 arises from the fact that the nebulizer orifice 47 is spaced from the flame, shielded therefrom by baffle plate 57 and cooled by atmospheric air drawn through air passage 60 and as a consequence remains relatively cool. Many known fuel oil burner nozzles are exposed to heat and encounter problems because the fuel oil remaining in the nozzle, when the burner shuts off, evaporates and leaves troublesome residue.

Yet another important advantage of the burner device of FIGS. 5 and 6 arises from the fact that the burning of the fuel oil occurs partly within the confines of combustion cone 61, causing the cone to become hot. The introduction of the fuel oil/air flow into the interior of the heated cone causes the fine fuel oil particles to almost instantaneously evaporate and mix completely with the air within the cone, promoting hydroxylation of the fuel oil resulting in complete and efficient combustion. In the process of hydroxylation, oxygen from the air reacts with the hydrocarbon molecules of the fuel oil to produce hydroxylated compounds which break down into aldehydes, compounds which burn with a clear blue, soot-free flame.

As can be understood from the foregoing, the preferred mixing elements used according to the present invention comprise two cooperating members having aligned transverse holes and having conforming, contacting surfaces, a minor portion of the surface area of one or both members being provided with narrow shallow recesses or interstices forming small liquid passages between said members which passages communicate with a liquid supply chamber and have small exit orifices which communicate with a central receptive surface of the lower member which extends between the larger central hole in the upper member and the smaller central hole in the lower member.

The cooperating members preferably are flat stainless steel plates or discs having a thickness between about 0.005 inch and 0.05 inch. However the members may be formed of glass, plastic or other inert, liquid-impervious materials which have a good affinity for the particular liquids used therewith, i.e., hydrophilic materials or coatings for water or oleophilic materials or coatings for oils.

The cooperating members may be of similar or different thickness and of the same or different material.

It is not necessary that there are recesses formed in the upper disc or plate or that such recesses extend to the periphery thereof as long as there is a very small liquid orifice which communicates with the liquid supply chamber and opens onto a receptive filming surface on the lower member. For example the lower disc may be provided with a sizeable transverse liquid hole, spaced from the transverse gas hole, which communicates with the liquid supply chamber and with a liquid orifice comprising a very small space or recesses between the upper and lower discs.

Figure 7:
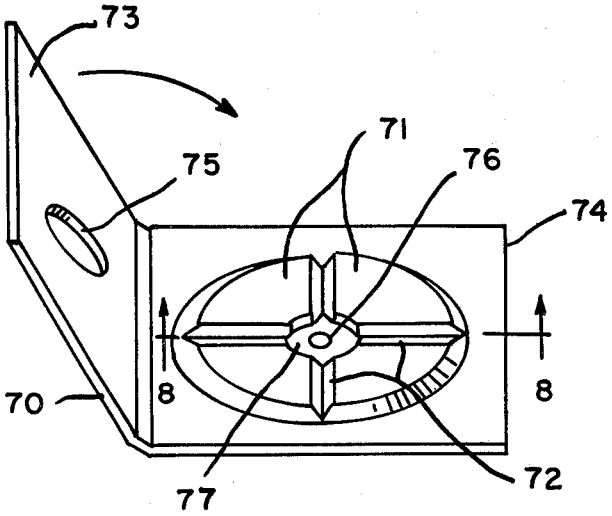

Preferably the mixing element comprises a unitary element which is easily removable and replaceable and which comprises upper and lower plates or discs which are attached to each other to prevent relative movement or slippage therebetween such as the embodiments of FIGS. 4 and 7 of the drawings. Thus if the mixing element becomes worn or contaminated it can be discarded and replaced with a new one. Attachment of the elements, or other means of preventing relative movement or slippage such as illustrated by FIGS. 9 and 10 of the drawings, is most important in cases where the transverse gas holes are not centered in the discs or plates, or where several gas holes are present, whereby alignment can be lost if the discs or plates move relative to each other.

FIGS. 7 to 13 illustrate other forms of mixing elements which can be used according to the present invention.

Figure 8:
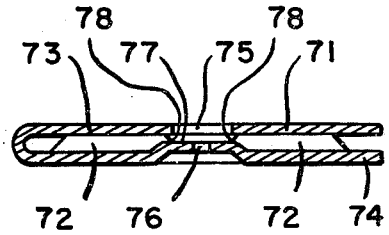

Thus FIGS. 7 and 8 illustrate a unitary mixing element 70 such as a thin stainless steel plate which is folded over in a central position after one end thereof has been pressed to form smooth-surfaced flat raised areas 71 leaving therebetween spaced recesses 72. When the plate is folded over, as shown by FIG. 8, the undersurface of the top plate 73 makes intimate sealing contact with the raised surfaces 71 of the lower plate 74 whereby the only passages therebetween are the shallow recesses 72 and narrow orifice 78. In folded-over position the larger central opening 75 in plate 73 is aligned with the smaller central opening 76 in plate 74 to provide a filming surface 77 extending from the periphery of the larger opening 75 to the periphery of the smaller opening 76 which is the gas orifice, filming surface 77 communicating with the very narrow orifice 78 formed by the space between the underside of top plate 73 and the extensions of surface 77 to the recessed areas 72 of the lower plate 74 to receive a thin film of liquid for further filming and nebulization.

Figure 9:
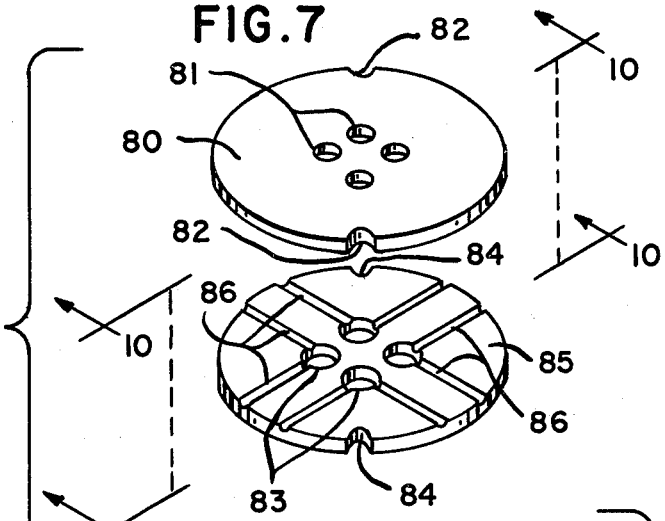
Figure 10:
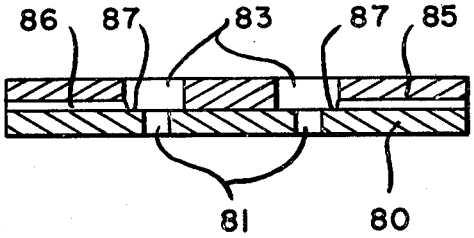

FIGS. 9 and 10 illustrate a mixing element comprising correspondingly notched discs provided with a multiplicity of gas passages. The discs are shown in inverted position in FIG. 9 for purposes of illustration. Thus the disc 80, which is the lower disc when assembled, comprises four small central gas orifices 81 and two opposed peripheral notches 82 corresponding in size and location to two peripheral notches 84 on the plate 85 which is the upper plate when assembled and which also contains four larger orifices 83. The notches 82 and 84 are in alignment with each other when the discs 80 and 85 are assembled. The nebulizer device, such as the inner gasket washer 18 of FIG. 1, is provided with means for extending into the aligned notches 82 and 84 to prevent relative slippage or rotation of discs 80 and 85, or this result may be accomplished by the washer 18 per se due to its compressibility in areas adjacent the notches.

As shown, the upper plate 85 is provided with a series of spaced recesses 86 comprising fine scratches which extend from the periphery of disc 85 to openings 83 to form liquid orifices which exit onto the filming surfaces 87 which communicate with the gas orifices 81 to convey liquid from the liquid supply chamber to the gas flow. Obviously, the nebulizer device must be so constructed that all of the gas openings are unobstructed by the gasket 18 and by the central opening 23 of top plate 16.

Figure 11:
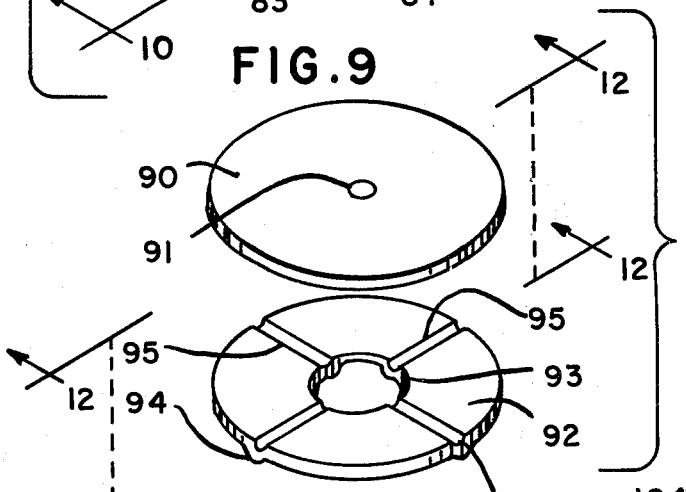
Figure 12:
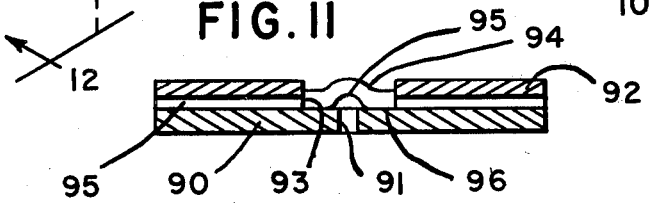

FIGS. 11 and 12 illustrate another mixing element shown in inverted position in FIG. 11 for purposes of illustration. Smooth disc 90, which is the lower disc when assembled, has a small central gas orifice 91 and a disc 92, which is the upper disc when assembled, has a larger central gas opening 93 and spaced recesses comprising diametric creases or presses 94 which extend from the periphery of disc 92 to opening 93 to form liquid orifices which exit onto filming surface 92 adjacent the central gas orifice 91. The creases 94 prevent the disc 92 from lying flat against disc 90 in the creased areas so that the thin shallow orifice spaces 95 are provided for the passage of the liquid from the liquid supply chamber into contact with the filming surface 96 for movement into the gas flow. The washer gasket 18 of FIGS. 1 and 2 deforms about creases 94 so as to perfectly seal disc 92 to gasket 18 while the upper surface (as shown in FIG. 11) of disc 92, adjacent the creases 94, contacts and sealingly engages the undersurface (as shown in FIG. 11) of disc 90 except in the central areas underlying opening 91.

Figure 13:
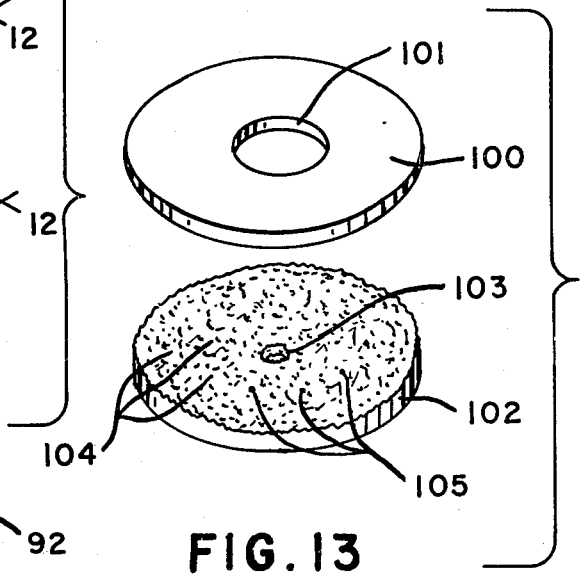

FIG. 13 illustrates yet another mixing element comprising a smooth upper disc 100 having a large central opening 101 and a lower disc 102 having a smaller central gas opening 103 and an upper surface comprising a multiplicity of interconnected recessed areas 104 of uniform depth surrounded by a multiplicity of peaks or plateaus 105 of uniform height corresponding to the original thickness of the disc 102. Such disc surfaces may be formed by sandblasting or otherwise chemically or mechanically etching the surface in a uniform and controlled manner whereby the original thickness of the disc is substantially retained in spaced areas or plateaus 105 surrounded by valleys or recessed areas 104 which are interconnected and which extend from the periphery of the disc to the central gas orifice 103, as illustrated. Uniformly roughened surfaces of this type are receptive to liquids, due to their porosity and are particularly resistant to becoming clogged because of the myriad of liquid orifices which provide alternative routes or passages for the liquid.

Suitable surfaces of this type may also be formed by pressing the disc against a die having an inversely-corresponding rough surface or, in the case of plastic discs, casting or molding the disc against a casting or molding surface having an inversely-corresponding rough surface. It should be noted that the filming surface, being that part of the upper surface of lower disc 102 lying between opening 101 in upper disc 100 and opening 103, need not be smooth. The cohesive force between the liquid being drawn into the gas flow and the liquid still present on the filming surface will draw the liquid across both rough or smooth surfaces.

As an alternative means for forming spaced recesses in the present discs or plates it is possible to apply a discontinuous layer of suitable material in a thickness of 0.01 inch or less to the surface of the discs or plates rather than removing surface material from the discs or plates. The end result is similar in appearance and function to the disc 20 of FIGS. 1 and 2, for instance, the raised areas surrounding the shallow recessed areas 28 being formed by applying a uniformly-thin discontinuous coating of inert material such as synthetic resin or metal to the smooth surface of the disc. This may be done using photosensitive resinous compositions which are exposed through a negative and then removed from the unexposed areas which will correspond to recessed areas 28, or by vacuum deposition of a metallic layer using a stencil to prevent deposition in the spaced areas which will correspond to recessed areas 28. The discontinuous coating may also be applied by speckle coating techniques where specks of suitable composition are sprayed onto the surface of the plate or disc to form a multiplicity of spaced peaks of uniform height equal to 0.01 inch or less over the entire surface of the plate or disc. A similar result may be obtained by applying uniformly-sized particles of heat-fusible powder to the disc surface, such as by electrostatic techniques, and then heat-fusing the particles to the disc surface to form spaced peaks which are 0.01 inch or less in height. Also discs or plates cast or otherwise formed with uniformly rough surfaces having recesses of the required depth may also be used. Other suitable methods will be apparent to those skilled in the art in the light of the present disclosure.

As will be apparent to those skilled in the art, variations may be made in the various structures illustrated by the drawing and the nebulizer mixing elements of one structure may be interchanged with those of the other illustrated structures, obvious slight modifications being made where necessary. Thus, the present invention encompasses the use of nebulizer discs or plates which are mounted evenly spaced from each other or are compressed into discontinuous contact with each over a substantial or major portion of their surface areas to provide at least one thin liquid orifice therebetween. The discs or plates may be identical or different thicknesses and function with either a pressurized liquid or gas supply or a vacuum-drawn liquid or gas supply.

An essential feature of the present invention is that the liquid orifice be sufficiently small so that liquid is not drawn from the liquid orifice except as liquid is supplied to the liquid orifice. That is, liquid is not drawn out from the interior of the liquid orifice because the capillary force holding the liquid in the small liquid orifice is comparatively large because of the smallness of the liquid orifice, and the net combined effects of the other forces acting on the liquid, in the absence of liquid being supplied to the liquid orifice, are insufficient to draw liquid from the liquid orifice. Consequently, liquid does not flow from the liquid orifice unless supplied to the liquid orifice. It is this essential feature—liquid flows onto the filming surface from the liquid orifice at the same steady rate at which liquid is supplied to the liquid orifice—which makes it possible to supply a steady flow of liquid to the filming surface at a controlled low rate, which rate can be set to be less than the rate at which the cohesive force between the liquid being dispersed at the gas orifice and the liquid on the filming surface is capable of drawing liquid from the liquid orifice. The fact that the liquid may be supplied to the filming surface at a steady rate which is less than the rate at which the cohesive force between the liquid being dispersed at the gas orifice and the liquid on the filming surface is capable of drawing liquid from the liquid orifice makes it possible to stretch the liquid on the filming surface to a stable stretched exceedingly thin liquid film. This essential feature, in conjunction with the adhesive force between the liquid and the filming surface, permits pneumatic nebulizers based on the present invention to operate in any direction, such as straight down, and/or under vibration.

The controlled flow of liquid through the narrow liquid orifice can be achieved by any of a number of possible means which either control the pressure of the liquid upstream of the orifice relative to the ambient pressure at the mouth of the orifice or control the rate at which liquid of sufficient pressure is supplied to the orifice. The rate of flow of the liquid through the orifice may also be controlled entirely or in part by utilizing various sized orifices, provided, of course, they are sufficiently small as described above and the liquid's upstream pressure is sufficiently high.

Preferably, at least one of the present plates or discs is flexible or pliant and the plates or discs are pressed together so that their surfaces make contact with each other over a substantial or major portion of their conforming surface areas, whereby the plates or discs support each other across their entire surface areas against flexing together in the areas of the shallow recesses and against changing the spacing in such recessed areas, thereby providing stable liquid orifices, as illustrated by FIGS. 2 and 3. In some cases where shallow recesses are used in the surface of flexible discs to form the liquid orifices, such recesses should be narrow to prevent the plates or discs from flexing into or away from the recessed areas when the discs are pressed together in the assembled device. The recesses preferably are 0.01 inch or less in depth, and if desired the width and the depth of the recesses may be about the same although preferably the width is substantially greater than the depth as shown by the drawings. When the discs or plates are assembled in contact with each other, the recesses present in the surface of one of the plates or discs provide a narrow shallow passageway therebetween, constituting the liquid orifice, which narrow shallow passageway is confined between or surrounded by contacting surfaces of the plates or discs so as to preclude flexing of the discs or plates in the recessed areas.

It is noted that the present discs or plates, or at least one thereof, may be formed of material such as thin stainless steel which is sufficiently flexible or pliant to allow the plate or disc to be mounted in contact with or closely-spaced from the surface of the other plate or disc of the mixing element to provide a liquid passage or orifice of variable smallness therebetween as taught by U.S. Pat. No. 4,018,387. In some cases where shallow recesses are used in the surface of flexible discs to form the liquid orifices, such recesses may be wide to permit the flexing of the disc into or away from the recess areas when the discs are pressed together in the assembled device and liquid forced through the recesses, thereby permitting the smallness of the recessed areas to be varied by adjusting the force pressing the discs together and/or the pressure of the liquid flowing through the recesses as taught by U.S. Pat. No. 4,081,387.

It should be understood that the specific structures of the nebulizer devices set forth in the figures of the drawing are not critical except with respect to accommodating the present mixing elements and that variations will be apparent to those skilled in art for purposes of simplification or modification of the devices to a particular use where size, shape, appearance or other factors are to be considered.

Variations and modifications may be made within the scope of the claims and portions of the improvements may be used without others.

We claim:

1. A nebulizer device capable of reducing a flowable liquid to an ultrafine dispersion of liquid particles in a propellant gas, comprising a mixing element comprising (a) pair of superposed members which have conforming contacting surfaces which sealingly engage each other in the contacting areas and which provide (a) in areas between said contacting areas at least one liquid passage having an entrance between said surfaces of said superposed members adapted to receive a supply of said flowable liquid and an exit orifice between said surfaces of said superposed members which is sufficiently small that when filled with said liquid, the liquid is retained therein by capillary attraction and is prevented from flowing therefrom under ambient conditions except as liquid is supplied through said passage to said exit orifice; (b) a filming surface comprising an extension of one of said conforming surfaces which is beyond the area in which said members are superposed and which communicates with said exit orifice and has some affinity for said liquid, and (c) a gas orifice comprising an edge of said filming surface spaced from said exit orifice and communicating with a gas conduit adapted to transmit a supply of gas through said gas orifice at an angle relative to said filming surface and through said mixing element without contacting the other of said contacting members, and means for maintaining the liquid upstream of said exit orifice at a sufficiently greater pressure than the atmosphere at the outlet of said exit orifice to force the liquid through said exit orifice independently of the effect of the flow of said gas through said gas orifice, whereby liquid which flows through said liquid passage at a controlled rate is adapted to exit said exit orifice as a thin liquid stream which adheres to said filming surface as a continuous thin liquid film which extends to the edge of said filming surface comprising said gas orifice where the thin liquid film is adapted to be drawn into the gas flowing through said gas passage, the drawing of said liquid film into said gas flow causing said film to be stretched across said filming surface as a very thin continuous film of said liquid for introduction to said gas flow to form said ultrafine dispersion.

2. A nebulizer device according to claim 1 which comprises means for maintaining the liquid upstream of said exit orifice at a sufficiently greater fixed or adjustable pressure than the atmosphere at the outlet of said exit orifice to force the liquid through said exit orifice at a controlled rate.

3. A nebulizer device according to claim 2 which comprises means from varying the pressure of said liquid upstream of said exit orifice, predetermined variations in the pressure of said liquid causing various predetermined amounts of liquid to flow through said exit orifice.

4. A nebulizer device according to claim 1 which comprises means for supplying said liquid to said exit orifice at an adjustable rate of flow and at sufficient pressure to force the liquid through said exit orifice at said adjustable rate of flow.

5. A nebulizer device according to claim 1 which comprises means for supplying said liquid to said exit orifice at sufficient pressure to force the liquid therethrough, the rate of flow of said liquid through said exit orifice being controlled by the smallness of said exit orifice.

6. A nebulizer device according to claim 5 which comprises means for varying the smallness of said exit orifice, predetermined variations in the smallness of said exit orifice causing various predetermined amounts of liquid to flow through said exit orifice.

7. A nebulizer device according to claim 1 in which said device is devoid of any surface beyond said gas orifice capable of being contacted by said ultrafine dispersion.

8. A nebulizer device according to claim 1 in which said gas orifice is a restricted sharp-edged orifice.

9. A nebulizer device according to claim 1 in which said exit orifice is about 0.010 inch or less in diameter or spacing.

10. A nebulizer device according to claim 1 in which said exit orifice is about 0.003 inch or less in diameter or spacing.

11. A nebulizer device according to claim 1 in which said gas orifice comprises at least one transverse hole in said filming surface.

12. A nebulizer device according to claim 1 in which said mixing element comprises at least one removable, replaceable recessed member.

13. A nebulizer device according to claim 1 in which said mixing element comprises at least one flexible member.

14. A nebulizer device according to claim 1 in which said mixing element comprises at least one removable, replaceable flexible member.

15. A nebulizer device according to claim 1 in which said mixing element comprises a pair of members which have superposed conforming, contacting surfaces which sealingly engage each other in the contacting areas, at least one of said contacting surfaces being provided with at least one shallow recess which comprises said liquid passage.

16. A nebulizer device according to claim 15 in which the superposed members of said mixing element are attached to each other as a unitary element.

17. A nebulizer device according to claim 15 in which said superposed members comprise a single plate which is folded over onto itself.

18. A nebulizer device according to claim 1 which further comprises means for varying the rate of flow of said gas through said gas orifice, predetermined variations in the rate of the flow of said gas causing various predetermined amounts of gas to combine with the liquid at the gas orifice of said device to produce ultrafine dispersions having variable predetermined concentrations.

19. A nebulizer device according to claim 1 which further comprises a combustion chamber communicating with said gas orifice and adapted to receive said ultrafine dispersion for combustion therein.

20. A nebulizer device according to claim 1 in which said filming surface comprises a material which has good affinity for the particular liquid used therewith.

21. A nebulizer device capable of reducing a flowable liquid to an ultrafine dispersion of liquid particles in a propellant gas, comprising a mixing element comprising two superimposed members having conforming surfaces which supportingly engage each other over a substantial portion of the surface areas of each, at least one of said members being provided with at least one shallow recess to form a thin liquid passage between said contacting members which is adapted to receive a supply of flowable liquid and has an exit orifice sufficiently small that when filled with said liquid the liquid is retained therein by capillary attraction and is prevented from flowing therefrom under ambient conditions except as liquid is supplied through said passage to said exit orifice, a filming surface communicating with said small exit orifice and having some affinity for said liquid, a gas orifice which comprises an edge of said filming surface, said edge being spaced from said exit orifice, said filming surface being adapted to receive a supply of liquid from said exit orifice and to cause said liquid to adhere to said surface as a continuous thin film which extends to said gas orifice, a means for controlling the rate of flow of said liquid through said small exit orifice, and a conduit associated with said gas orifice and adapted to supply a continuous flow of gas through said gas orifice and across the edge of said filming surface whereby said flowable liquid which is forced through said small exit orifice at a controlled rate forms a very thin continuous film of said liquid on said filming surface which is drawn into the gas flowing through said gas orifice to form an ultrafine dispersion of said liquid in said gas.

22. A nebulizer device according to claim 21 which comprises means for maintaining the liquid upstream of said exit orifice at a sufficiently greater fixed or adjustable pressure than the atmosphere at the outlet of said exit orifice to force the liquid through said small exit orifice at a controlled rate.

23. A nebulizer device according to claim 22 which comprises means for varying the pressure of said liquid causing various predetermined amounts of liquid to flow through said exit orifice.

24. A nebulizer device according to claim 21 which comprises means for supplying said liquid to said exit orifice at an adjustable rate of flow and at sufficient pressure to force the liquid through said exit orifice at an adjustable rate of flow.

25. A nebulizer device according to claim 21 which comprises means for supplying said liquid to said exit orifice at sufficient pressure to force the liquid therethrough, the rate of flow of said liquid through said exit orifice being controlled by the smallness of said exit orifice.

26. A nebulizer device according to claim 25 which further comprises means for varying the smallness of said exit orifice, predetermined variations in the smallness of said exit orifice causing various predetermined amounts of liquid to flow through said exit orifice.

27. A nebulizer device according to claim 21 in which said device is devoid of any surface beyond said gas orifice capable of being contacted by said ultrafine dispersion.

28. A nebulizer device according to claim 21 in which said gas orifice is a restricted sharp-edge orifice.

29. A nebulizer device according to claim 21 in which said exit orifice is about 0.010 inch or less in diameter or spacing.

30. A nebulizer device according to claim 21 in which said exit orifice is about 0.003 inch or less in diameter or spacing.

31. A nebulizer device according to claim 22 in which said gas orifice comprises at least one transverse hole in said filming surface.

32. A nebulizer device according to claim 21 in which said mixing element comprises at least one removable, replaceable recessed member.

33. A nebulizer device according to claim 21 in which said mixing element comprises at least one flexible member.

34. A nebulizer device according to claim 21 in which said mixing element comprises at least one removable, replaceable flexible member.

35. A nebulizer device according to claim 21 in which the superposed members of said mixing element are attached to each other as a unitary element.

36. A nebulizer device according to claim 21 in which said superposed members comprise a single plate which is folded over onto itself.

37. A nebulizer device according to claim 21 which further comprises means for varying the rate of flow of said gas through said gas orifice, predetermined variations in the rate of the flow of said gas causing various predetermined amounts of gas to combine with the liquid at the gas orifice of said device to produce ultrafine dispersions having variable predetermined concentrations.

38. A nebulizer device according to claim 21 which further comprises a combustion chamber communicating with said gas orifice and adapted to receive said ultrafine dispersion for combustion therein.

39. A nebulizer device according to claim 21 in which said filming surface comprises a material which has good affinity for the particular liquid used therewith.

40. Method for reducing a flowable liquid to an ultrafine dispersion of liquid particles in a propellant gas comprising the steps of:

(a) confining a flowable liquid within a chamber having as the only means for escape at least one orifice comprising the entrance opening of at least one shallow passage present between two superposed members, the surfaces of which conform to and supportingly engage each other over a substantial portion of the surface areas of each surrounding said passage, said passage having an exit orifice which is sufficiently small that when filled with liquid the liquid is retained therein by capillary attraction and is prevented from flowing therefrom under ambient conditions except as liquid is supplied to the orifice, (b) applying pressure to said liquid to cause a controlled supply of said liquid to flow through said exit orifice as a continuous thin liquid stream having a thickness of about 0.010 inch or less onto a filming surface having some affinity for said liquid whereby said liquid forms a thin continuous liquid film on said filming surface extending from said exit orifice to an edge of said filming surface which is spaced from said exit orifice, and (c) applying pressure to cause a supply of gas to flow at sufficient velocity through a gas orifice which communicates with said edge of said filming surface and at an angle to and against said continuous liquid film which extends to said edge independently to the effect of said gas flow, thereby causing said continuous liquid film to become stretched at a very thin continuous film of said liquid on said filming surface and to be drawn into said gas flow to form said ultrafine dispersion, said dispersion being formed as said gas and liquid make contact.

41. Method according to claim 40 which comprises applying sufficient variable pressure to said liquid upstream of said exit orifice to control the amount of said liquid passing through said exit orifice.

42. Method according to claim 40 which comprises supplying a variable flow of said liquid to said exit orifice at sufficient pressure to force said variable flow of liquid through said exit orifice to control the amount of said liquid passing through said exit orifice.

43. Method according to claim 40 which comprises supplying the liquid to said exit orifice at sufficient pressure to force the liquid therethrough and adjusting said exit orifice to be of sufficient small size to control the amount of said liquid passing therethrough.

44. Method according to claim 40 which comprises applying variable pressure to said gas to vary the amount of said gas passing through said gas orifice.

45. Method according to claim 40 in which said gas orifice is a restricted sharp-edged gas orifice and said continuous flow of gas is forced therethrough so as to cause the formation of a vena contracta in said gas flow, and said continuous thin liquid film is drawn into said continuous flow of gas substantially simultaneously with the formation of the vena contracta of said gas flow to form said ultrafine dispersion of liquid particles in said propellant gas.

46. Method according to claim 40 which comprises permitting said ultrafine dispersion of liquid particles in said propellant gas to be released directly into a larger receptacle without striking any solid surface.

47. Method according to claim 40 in which said liquid is a combustible liquid and said ultrafine dispersion is released into a combustion chamber and ignited.

48. Method according to claim 40 in which said filming surface is of a material which has good affinity for the particular liquid used therewith.

49. Method according to claim 40 in which said continuous thin liquid stream has a thickness of about 0.003 inch or less.

* * * * *

UNITED STATES PATENT AND TRADEMARK OFFICE

CERTIFICATE OF CORRECTION

PATENT NO. : 4,161,281

DATED : July 17, 1979

INVENTOR(S) : ELISHA W. ERB and DARREL R. RESCH

It is certified that error appears in the above-identified patent and that said Letters Patent are hereby corrected as shown below:

col. 14, line 43, replace "zone" with --cone--; col. 14, line 61, replace "bove" with --above--; col. 19, line 10 after "be" insert --of--;

col. 20, line 47, delete "(a)"; claim 31, line 1, replace "22" with --21--; col. 24, line 24, replace "to" with --of--;

Signed and Sealed this

*Fourth* Day of *December 1979*

[SEAL]

*Attest:*

SIDNEY A. DIAMOND

*Attesting Officer*

*Commissioner of Patents and Trademarks*